US007362288B2

(12) United States Patent
Jang

(10) Patent No.: US 7,362,288 B2
(45) Date of Patent: Apr. 22, 2008

(54) ORGANIC ELECTROLUMINESCENCE PANEL, A DISPLAY WITH THE SAME, AND AN APPARATUS AND A METHOD FOR DRIVING THEREOF

(75) Inventor: Hyeon-Yong Jang, Osan (KR)

(73) Assignee: Samsung Electronics Co., Ltd. (KR)

( * ) Notice: Subject to any disclaimer, the term of this patent is extended or adjusted under 35 U.S.C. 154(b) by 465 days.

(21) Appl. No.: 10/492,671

(22) PCT Filed: Nov. 7, 2001

(86) PCT No.: PCT/KR01/01897

§ 371 (c)(1),
(2), (4) Date: Nov. 3, 2004

(87) PCT Pub. No.: WO03/041042

PCT Pub. Date: May 15, 2003

(65) Prior Publication Data

US 2005/0057454 A1 Mar. 17, 2005

(30) Foreign Application Priority Data

Oct. 18, 2001 (KR) ..... 2001-64340

(51) Int. Cl.
*G09G 3/30* (2006.01)

(52) U.S. Cl. ..... 345/76; 345/77

(58) Field of Classification Search ..... 345/76–81; 315/169.3; 313/463

See application file for complete search history.

(56) References Cited

U.S. PATENT DOCUMENTS 5,990,629 A * 11/1999 Yamada et al. ..... 315/169.3

(Continued)

FOREIGN PATENT DOCUMENTS

CN 1216135 5/1999

(Continued)

OTHER PUBLICATIONS

PCT International Search Report; International application No.: PCT/KR01/01897; International filing date: Nov. 7, 2001; Date of Mailing: Jul. 22, 2002.

(Continued)

*Primary Examiner*—Jimmy H Nguyen
(74) *Attorney, Agent, or Firm*—Cantor Colburn LLP

(57) ABSTRACT

The present invention provides an organic electroluminescence panel, an organic electroluminescence display provided therewith, and driving apparatus and method thereof. The organic electroluminescence display according to the present invention includes a plurality of display groups obtained by grouping organic electroluminescence display cells associated with predetermined numbers of scanning lines. Each display cell includes a driving transistor having a first terminal connected to a second terminal of an organic electroluminescence element and a second terminal connected to a second polarity terminal and controlling current flow from a first polarity terminal to the second polarity terminal or vice versa in response to the output data signal from a third terminal of a switching transistor to control light-emission of the organic electroluminescence element. The light emission of a current display group area among the display groups and the scanning of a next display group area are simultaneously performed. As a result, the present invention improves the brightness without adding a switching transistor in each organic EL display cell, a signal selecting line for each scanning line, and a row driving IC. In addition, the present invention is capable of manufacturing an organic EL display device at low cost and increasing its yield.

23 Claims, 4 Drawing Sheets

U.S. PATENT DOCUMENTS

| | | | | |
|---|---|---|---|---|
| 6,133,903 | A | 10/2000 | Lee et al. | 345/148 |
| 6,362,800 | B1 | 3/2002 | Moon | |
| 6,847,341 | B2 * | 1/2005 | Kimura et al. | 345/78 |
| 7,176,912 | B2 * | 2/2007 | Kota et al. | 345/211 |
| 2001/0022565 | A1 * | 9/2001 | Kimura | 345/82 |

FOREIGN PATENT DOCUMENTS

| | | |
|---|---|---|
| JP | 11-282419 | 10/1999 |
| KR | 10-237203 | 10/1999 |
| KR | 100264462 B | 8/2000 |

OTHER PUBLICATIONS

PCT International Preliminary Examination Report; Internation application No.: PCT/KR01/17897; Interantional filing date: Nov. 7, 2001; Date of Completion: Jul. 30, 2003.

ESP@CENET. [online]; [retrieved on Oct. 25, 2007]; retrieved from the Internet http://v3.espacenet.com/textdoc?DB=EPODOC&IDX=KR100264462B&F=0 Moon Seong-Hak, Method and Apparatus for Driving Three-Electrodes Surface-Discharge Patent Abstract, KR100264462b, Aug. 16, 2000. LG Electronics Inc., Korea.

* cited by examiner

ORGANIC ELECTROLUMINESCENCE PANEL, A DISPLAY WITH THE SAME, AND AN APPARATUS AND A METHOD FOR DRIVING THEREOF

BACKGROUND OF THE INVENTION (a) Field of the Invention

The present invention relates to an organic electroluminescence (EL) display, and in particular, to an organic EL panel, a display provided therewith and a driving apparatus and method thereof, capable of sufficiently implementing the gray display only with a simple organic EL display cell.

(b) Description of the Related Art

Examples of currently used displays are most widely employed cathode ray tubes (CRTs) and liquid crystal displays (LCDs) which are increasingly applied to computers. However, since the CRTs and the LCDs have the disadvantages that the CRTs are too heavy and have large volume and the LCDs are not bright, have poor lateral visibility, and have less efficiency, they do not meet users' requirements.

Therefore, many researchers try to develop cheaper, more efficient, thinner and lighter displays, and one of attractive displays as a next generation display is organic light emitting devices (OLEDs).

The OLEDs are based on electroluminescence (EL: light emission upon application of electricity) of specific organic materials or polymers. Since the OLEDs do not require back light, they can be established to be slim and easily manufactured at lower cost compared with the LCDs. In addition, the OLEDs have wide viewing angle and are bright compared with the LCDs, they have been vigorously researched worldwide.

FIG. 1 is a circuit diagram illustrating an example of a conventional organic EL driving device.

Referring to FIG. 1, a typical organic EL driving device includes a switching transistor Qs, a storage capacitor Cst, a driving transistor $Q_D$ and an organic EL element OLED.

The organic EL display is driven by active type driving with increased light-emitting duty but not by passive type driving emitting light only upon selection of one transverse scanning line, since the brightness of the organic EL display is low relative to the CRT. An active layer of the light-emitting cell emits light in proportion to an injected current density.

However, the driving transistor $Q_D$ providing current for a light emitting element, i.e., the organic EL element OLED and the related EL element OLED connected to one terminal of the driving transistor $Q_D$ have so wide distributions of voltage versus brightness characteristic that the organic EL display has a trouble in displaying grays.

In order to realizing uniform gray display but be little influenced by such distributions of voltage versus brightness characteristic, a kind of time-divisional gray display called a Display-Period-Separated (hereinafter, referred to as "DPS") driving is used.

However, the DPS driving is disadvantageously limited to a display product with a few grays and low resolution, since the driving frequency may not be increased due to limitation of the operating speed of the switching transistor Qs, and it is hard to improve the brightness due to the relatively small light-emitting display time resulted from long data scanning time.

In order to solve these problems, a Simultaneous-Erasing-Scan (hereinafter, referred to as "SES") driving is used, which improve the brightness by enlarging the display duty relative to the DPS driving.

FIG. 2 shows another example of another conventional organic EL device, and in particular, an example of an organic EL device suitable for application of the SES driving.

Referring to FIG. 2, an exemplary organic EL driving device includes a first switching transistor $Q_{s1}$, a second switching transistor $Q_{s2}$, a capacitor Cst, a driving transistor $Q_D$ and an organic EL element OLED. In the figure, a first terminal of the driving transistor $Q_D$ is connected to ground GND and a second terminal of the driving transistor $Q_D$ is connected to one terminal of the organic EL element OLED with the other terminal applied with a driving voltage (−Vee) of negative polarity. Alternately, the first terminal of the driving transistor $Q_D$ is applied with a driving voltage +Vee of positive polarity and the other terminal of the organic EL element OLED is connected to the ground GND.

However, the EL driving device shown in FIG. 2 additionally includes the second switching elements QS2 in respective organic EL cells, and further includes signal lines (ES line) for applying data erasing signals to the gate terminals of the second switching elements QS2 and row driving ICs generating the data erasing signals numbering in relation to a vertical resolution of the organic EL panel.

Therefore, there is a problem that this decreases productivity, thereby resulting in the increase of the product cost of the organic EL display.

Furthermore, there is a problem that the addition of the second switching transistor QS2 of a MOS type results in reduction of aperture ratio of the organic EL display cell to decrease the brightness and light-emitting efficiency.

SUMMARY OF THE INVENTION

An object of the present invention for solving the problems of the conventional art is to provide an organic EL panel capable of realizing effective gray display and having simple organic EL cells without decreasing the aperture ratio of the organic EL display cells.

Another object of the present invention is to provide an organic EL display including the organic EL panel.

Still another object of the present invention is to provide an apparatus for driving the organic EL display.

Still another object of the present invention is to provide a method for driving the organic EL display.

An organic electroluminescence panel according to an aspect of the present invention in order to accomplishing these objects is provided, which includes:

a plurality of data lines transmitting data signals;

a plurality of scanning lines transmitting scanning signals; and a plurality of organic electroluminescence display cells arranged in a matrix defined by the data lines and the scanning lines, wherein the display cells are grouped into a plurality of display groups, each display group including a plurality of display cells associated with a predetermined number of the scanning lines, each display cell including a switching transistor having a first terminal connected to one of the data lines, a second terminal connected to one of the scanning lines, and a third terminal, the switching transistor outputting the data signal through the third terminal in response to the scanning signal;

an organic electroluminescence element having a first terminal connected to a first polarity terminal and emitting light based on amount of applied current; and a driving transistor having a first terminal connected to a second terminal of the organic electroluminescence element and a second terminal connected to a second polarity terminal and controlling current flow from the first polarity terminal to the second polarity terminal or vice versa in response to the output data signal from the third terminal of the switching transistor to control light-emission of the organic electroluminescence element, wherein light emission of a current display group area among the display groups and scanning of a next display group area is simultaneously performed.

Preferably, the display cell further includes a storage capacitor having one terminal connected to the third terminal of the switching transistor and the other terminal connected to the second polarity terminal and maintaining the data signal from the third terminal of the switching transistor for a predetermined time.

The first polarity terminal is applied with a voltage of positive polarity or negative polarity, and the second polarity terminal is applied with a voltage of positive polarity or negative polarity.

In an exemplary organic electroluminescence panel, the second terminal of the driving transistor included in each display cell of the display groups is a grounded source terminal (or a drain terminal), the first terminal of the driving transistor is a drain terminal (or a source terminal) connected to the other terminal of the organic electroluminescence element for light emission, and the one terminal of the organic electroluminescence element is connected to the one terminals of the organic electroluminescence elements adjacent thereto left and right through a voltage supplying electrode and is applied with the organic electroluminescence driving voltage through the voltage supplying electrode.

In another exemplary organic electroluminescence panel the second terminal of the driving transistor included in each display cell of the display groups is a source terminal (or a drain terminal) applied with the organic electroluminescence driving voltage, the first terminal of the driving transistor is a drain terminal (or a source terminal) connected to the other terminal of the organic electroluminescence element for light emission, the one terminal of the organic electroluminescence element is grounded, and the source terminal (or the drain terminal) of the driving transistor is connected to the source terminals (or the drain terminals) of the driving transistors adjacent thereto left and right through a voltage: supplying electrode, and is applied with the organic electroluminescence driving voltage through the voltage supplying electrode.

An organic electroluminescence display according to an aspect of the present invention in order to accomplishing other objects is provided, which includes: an organic electroluminescence panel including a plurality of data lines transmitting data signals, a plurality of scanning lines transmitting scanning signals, and a plurality of organic electroluminescence display cells arranged in a matrix defined by the data lines and the scanning lines, wherein the display cells are grouped into a plurality of display groups, each display group including a plurality of display cells associated with a predetermined number of the scanning lines, each display cell including a switching transistor having a first terminal connected to one of the data lines, a second terminal connected to one of the scanning lines, and a third terminal, the switching transistor outputting the data signal through the third terminal in response to the scanning signal;

an organic electroluminescence element having a first terminal connected to a first polarity terminal and emitting light based on amount of applied current; and a driving transistor having a first terminal connected to a second terminal of the organic electroluminescence element and a second terminal connected to a second polarity terminal and controlling current flow from the first polarity terminal to the second polarity terminal or vice versa in response to the output data signal from the third terminal of the switching transistor to control light-emission of the organic electroluminescence element, wherein the organic electroluminescence display further comprises an organic electroluminescence driving voltage source sequentially outputting organic electroluminescence driving voltages to the display groups including predetermined numbers of rows disposed in the organic electroluminescence panel such that a current display group area of the display groups is applied with an organic electroluminescence driving voltage for scan, and after completion of the scan, the current display group area is applied with an organic electroluminescence driving voltage for light-emission and simultaneously a next display group area is applied with an organic electroluminescence driving voltage for scan.

A driving apparatus of an organic electroluminescence display including an organic electroluminescence panel including a plurality of data lines transmitting data signals, a plurality of scanning lines transmitting scanning signals, a plurality of organic electroluminescence display cells arranged in a matrix defined by the data lines and the scanning lines, according to an aspect of the present invention in order to accomplishing other objects, is provided, which includes:

an organic electroluminescence driving voltage source sequentially outputting organic electroluminescence driving voltages to the display groups including predetermined numbers of rows disposed in the organic electroluminescence panel such that a current display group area of the display groups is applied with an organic electroluminescence driving voltage for scan, and after completion of the scan, the current display group area is applied with an organic electroluminescence driving voltage for light-emission and simultaneously a next display group area is applied with an organic electroluminescence driving voltage for scan.

A driving method of an organic electroluminescence display including an organic electroluminescence panel including a plurality of data lines transmitting data signals, a plurality of scanning lines transmitting scanning signals, a plurality of organic electroluminescence display cells arranged in a matrix defined by the data lines and the scanning lines, according to an aspect of the present invention in order to accomplishing other objects, is provided, which includes:

(a) performing scanning operation for a current display group area of the display groups including predetermined numbers of rows disposed in the organic electroluminescence panel, and, after completion of the scan, controlling a light-emitting display operation for the current display group area and simultaneously performing scanning operation for a next display group area.

Preferably, (a) includes:

(a-1) scanning data to an n-th display group area of an organic electroluminescence panel including K display groups through K common terminals, where n is an integer larger than 1 and smaller than K;

(a-2) performing a light-emitting display operation for the n-th display group area after completion of the scanning for the n-th display group area in (a-1);

(a-3) determining whether the n is equal to the K according to the light-emitting display operation for the n-th display group area in (a-2);

(a-4), increasing the n value by '1' and returning to (a-1) if the n is not equal to the K in (a-3); and (a-5) ending display of image signals for one frame if the n is equal to the K in the step (a-3).

The an organic EL panel, a display provided therewith and a driving apparatus and method thereof improves the brightness without adding a switching transistor in each organic EL display cell, a signal selecting line for each scanning line, and a row driving IC. In addition, the present invention is capable of manufacturing an organic EL display device at low cost and increasing its yield.

DETAILED DESCRIPTION OF PREFERRED EMBODIMENTS

Now, embodiments of the present invention will be described in detail with reference to accompanying drawings for those skilled in the art to easily carry out.

Figure 3:
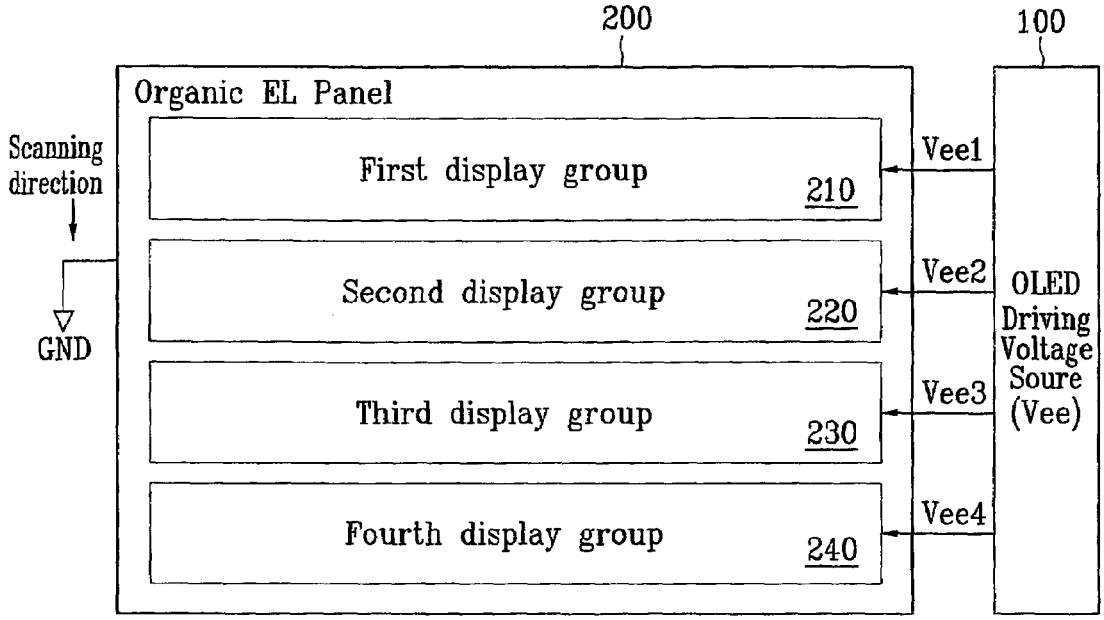
FIG. 3 is a diagram illustrating an organic EL display according to an embodiment of the present invention.
Figure 4:
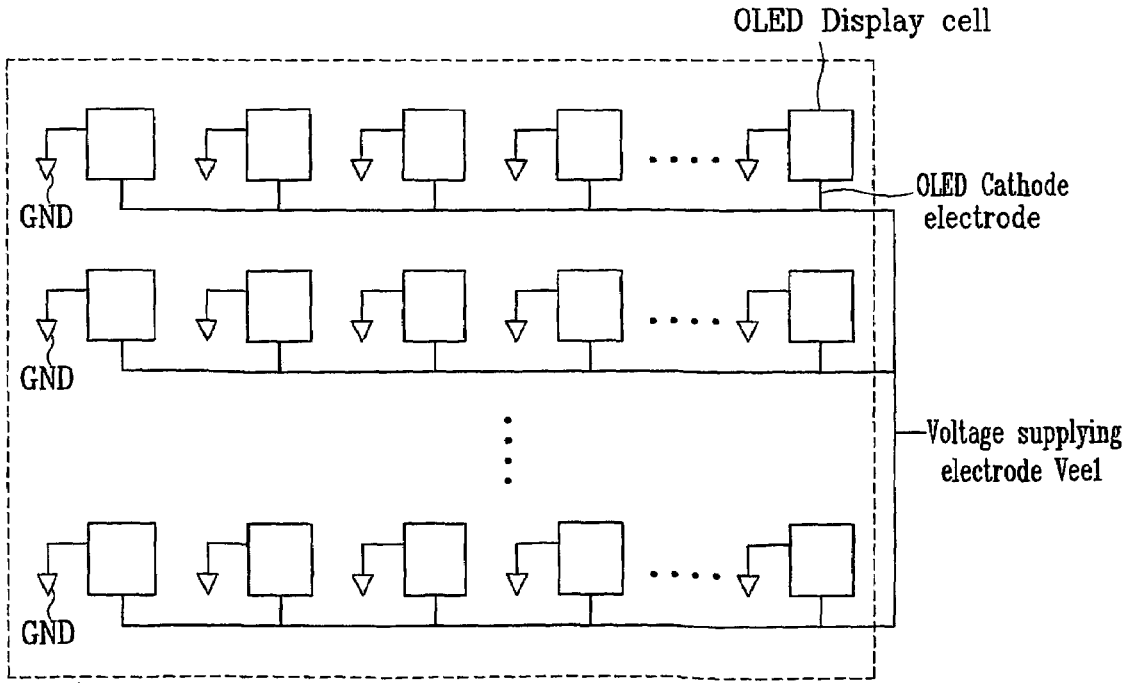
FIG. 4 is a diagram illustrating connections of voltage supplying electrodes of display groups in the organic EL panel shown in FIG. 3.

FIG. 3 is a diagram illustrating an organic EL display according to an embodiment of the present invention, and FIG. 4 is a diagram illustrating connections of voltage supplying electrodes of display groups in the organic EL panel shown in FIG. 3.

Referring to FIG. 3, an organic EL display according to an embodiment of the present invention includes an organic EL driving voltage source 100 and an organic EL panel 200. In FIG. 3, a data driver for outputting video data signals to the organic EL panel and a scan driver for selecting the video data signals are omitted since they have been well known in the related art, and thus the their operations are omitted.

The organic EL driving voltage source 100 outputs a plurality of organic EL driving voltages to the organic EL panel 200. Here, the organic EL driving voltages may have either positive polarity or negative polarity.

The organic EL panel 200 is divided into a plurality of display group areas, for example, four display group areas 210, 220, 230 and 240 and is applied with the organic EL driving voltages to display desired images.

In detail, scanning lines of the organic EL panel are grouped into a plurality of display groups along a vertical scanning direction. The example to be described has four display groups.

That is, first to last scanning lines are grouped into a first display group 210, a second display group 220, a third display group 230, and a fourth display group 240. The numbers of the scanning lines included in respective display groups are the same or different.

Figure 1:
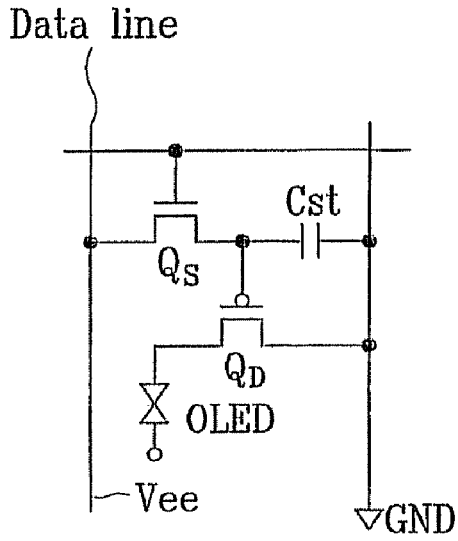
FIG. 1 PRIOR ART
FIG. 1 is a diagram illustrating an exemplary conventional organic EL device.
Figure 2:
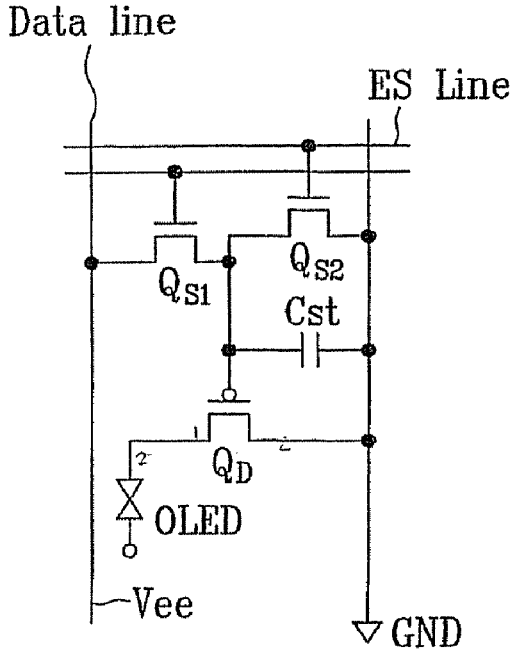
FIG. 2 PRIOR ART
FIG. 2 is a diagram illustrating another exemplary conventional organic EL device.

In addition, each organic EL display cell included in the display groups 210, 220, 230 and 240, as shown in FIG. 1, includes a switching transistor Qs, a storage capacitor Cst, a driving transistor $Q_D$ and an organic EL element OLED. AU the cathode electrodes of the organic EL elements OLED are connected.

In the figure, a first terminal of the driving transistor $Q_D$ is connected to ground GND and a second terminal of the driving transistor $Q_D$ is connected to one terminal of the organic EL element OLED with the other terminal applied with a driving voltage (−Vee) of negative polarity. Alternately, the first terminal of the driving transistor $Q_D$ is applied with a driving voltage +Vee of positive polarity and the other terminal of the organic EL element OLED is connected to the ground GND.

In addition, each display group 210, 220, 230 and 240 has an input terminal for application of an organic EL driving voltage. A first to a fourth organic EL driving voltages Vee1, Vee2, Vee3 and Vee4 are sequentially applied to the respective terminals.

Although it is shown in the figure that the positive driving voltages of positive polarity are applied, negative voltages can be applied in case of applying the driving voltages through the other terminal of the organic EL device, i.e., the cathode terminal.

It is preferable that the organic EL driving voltages Vee1, Vee2, Vee3 and Vee4 are applied to the terminals during display periods but not during scanning period of the corresponding display groups and that the four driving voltages have the same values. An organic EL driving voltage is obtained by shifting a previous organic EL driving voltage applied to a previous display group cell by a predetermined period.

Since the display cells of the exemplary organic EL display panel in according to the embodiment of the present invention are grouped into four display groups as described above, the organic EL voltage source 100 outputs the first driving voltage Vee1 to the first display group 210 and the second driving voltage Vee2 to the second divided display group 220, etc., thereby outputting the same organic EL driving voltage to the display groups at different times.

Figure 5:
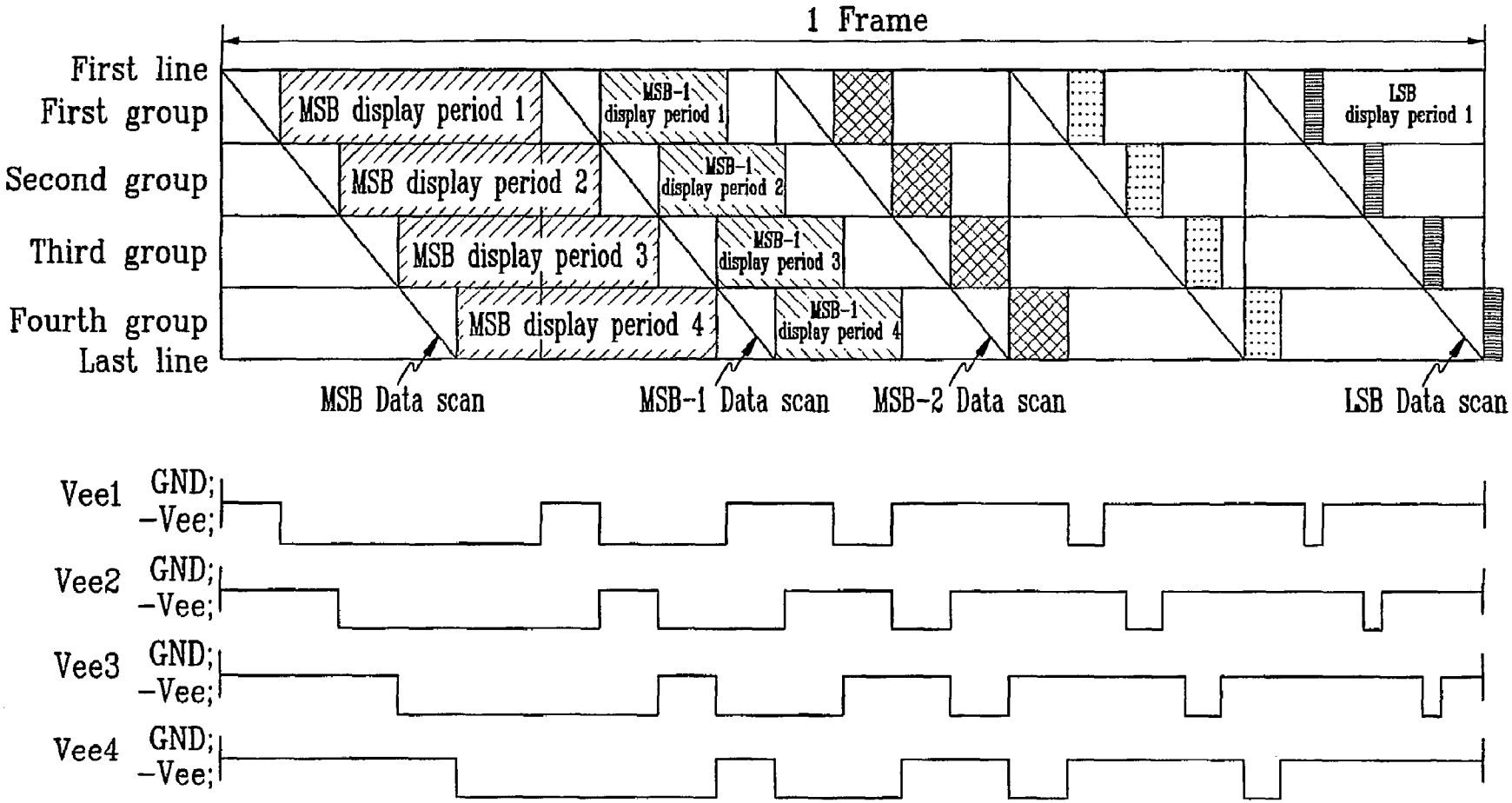
FIG. 5 is a timing diagram illustrating driving of each display group of an organic EL panel according to an embodiment of the present invention.

FIG. 5 is a timing diagram illustrating driving of each display group of the organic EL panel according to an embodiment of the present invention. The upper part of the diagram shows scanning periods and display periods of the organic EL panel during one frame. X axis in the transverse direction represents time of one frame and Y axis in the longitudinal direction represents first to last scanning lines of the organic EL panel.

In addition, the lower part of the diagram shows output timing of the first to the fourth EL driving voltages Vee1 to Vee4 from the organic EL driving voltage source, and the exemplary driving voltage has negative polarity.

Referring to FIGS. 3 to 5, the scanning is performed from the first scanning line, and the first organic EL driving voltage Vee1 is kept ground level during the scanning the first display group.

Therefore, the organic EL elements of the first display group 210 do not emit light, and just data writing operation of storing charges in the storage capacitors is performed.

Once the data scanning of the first display group 210 is completed, the first display group 210 enters into a display period, and the first organic EL driving voltage Vee1 supplies currents corresponding to the data state for the organic EL elements of the first display group 210 during a time corresponding to data weight given by DPS driving method. The display period varies depending on the data weight given by the DPS driving method.

Meanwhile, a first scanning line of the second display group is scanned during a predetermined period for supplying currents to the first display group 210.

The scanning is performed up to the fourth display group 240 using this driving method, and when the display period of the fourth display group is completed, the first display group 210 is scanned again so as to display images of the next frame.

The most significant bits (MSB) are displayed on the entire organic EL panel, and MSB-1, MSB-2, . . . LSB (least significant bits) are then displayed to complete one frame. The human feels the brightness of screen by integrating the amount of light in time during one frame.

The aforementioned DPS driving method generally displays an image by separately displaying its weights using binary image data. FIG. 5 shows an example that makes the image data be 5 bits and sequentially displays from MSB to LSB. On the contrary, the image may be sequentially displayed from LSB to MSB or in random order.

The above described embodiment of the present invention displays one frame using 5 bit image data and four display groups, but not limited to these.

Figure 6:
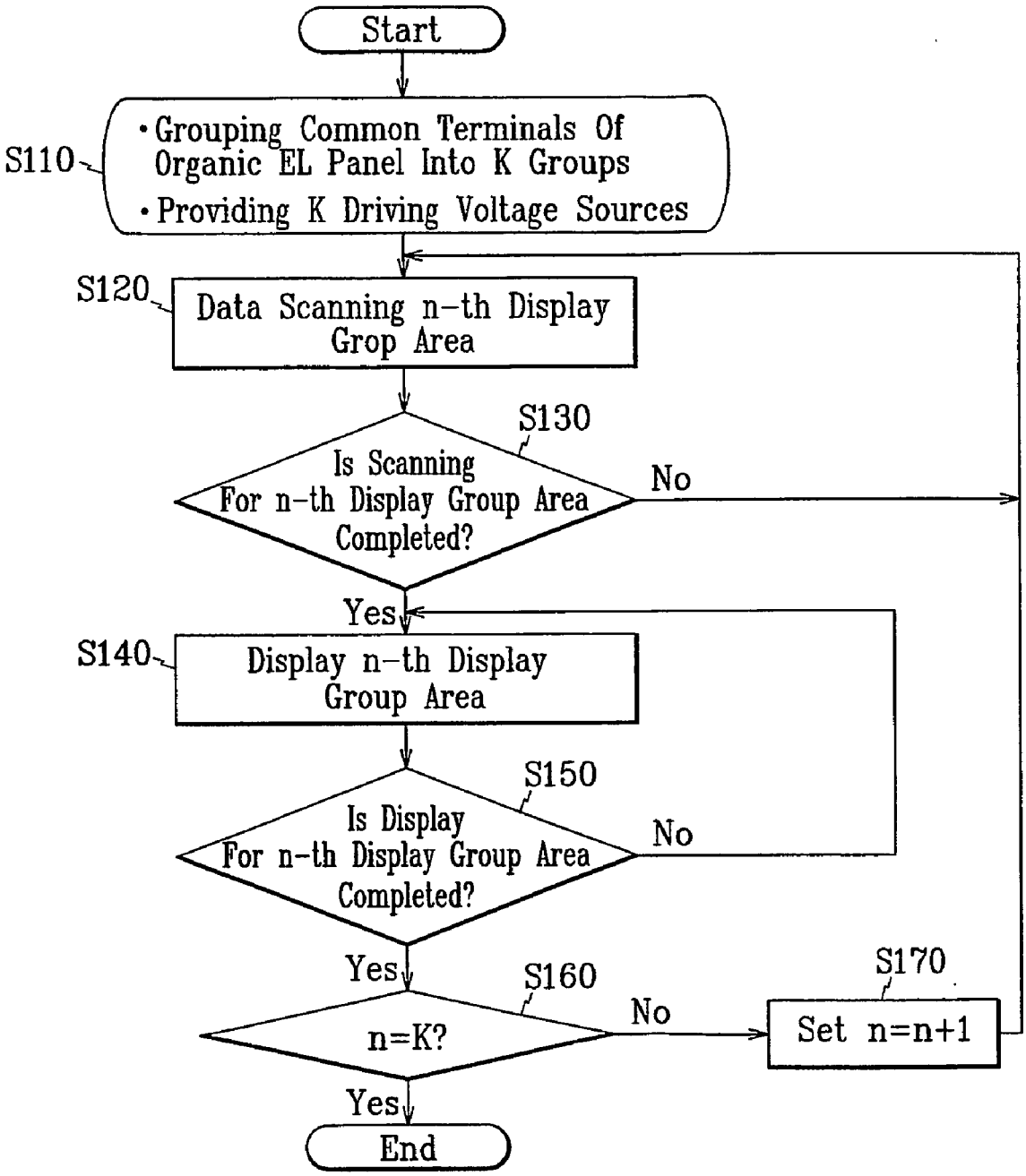
FIG. 6 is a flow chart illustrating a driving method of an organic EL panel according to an embodiment of the present invention.

FIG. 6 is a flow chart illustrating a driving method of an organic EL panel according to an embodiment of the present invention.

Referring to FIGS. 5 and 6, the common terminals of the organic EL panel are grouped into K groups, and K driving voltage sources are provided (step S110). The K driving voltage sources are assigned to drive the K respective display group areas.

When a condition of the step S110 is satisfied, the n-th display group area is data scanned (step S120). Here, 'n' is a natural number larger than '0' and equal to or less than 'K', and the scanning preferably starts from '1'.

Next, it is checked whether the scanning for the n-th display group area is completed (step S130). If the scanning for the n-th display group area is not completed, it is returned to the step S120 and the scanning for the n-th display group area continues. If the scanning for the n-th display group area is completed, the n-th display group areas are displayed (step S140).

Then, it is checked whether the display for the n-th display group area is completed (step S150). If the display for the n-th display group area is not completed, the procedure returns to the step S140.

In the step S150, if the display for the n-th display group area is completed, it is checked whether 'n=K' (step S160). If 'n=K', the procedure ends, but if 'n ≠ K', 'n' is increased by '1' (step S170), and then, the procedure returns to the step S120.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

As described above, the present invention improves the brightness of an organic EL display device without adding a switching transistor in each organic EL display cell, a signal selecting line for each scanning line, and a row driving IC. In addition, the present invention is capable of manufacturing an organic EL display device at low cost and increasing its yield.

Furthermore, since additional switching transistors are not provided, the aperture ratio of the display cell is improved, and thereby the brightness and the light emitting efficiency are increased.

What is claimed is:

1. An organic electroluminescence panel comprising:

a plurality of data lines transmitting data signals;

a plurality of scanning lines transmitting scanning signals; and a plurality of organic electroluminescence display cells arranged in a matrix defined by the data lines and the scanning lines, wherein the display cells are grouped into a plurality of display groups, each display group including a plurality of display cells associated with a predetermined plurality of the adjacent scanning lines, each display cell including a switching transistor having a first terminal connected to one of the data lines, a second terminal connected to one of the scanning lines, and a third terminal, the switching transistor outputting the data signal through the third terminal in response to the scanning signal;

an organic electroluminescence element having a first terminal connected to a first polarity terminal and emitting light based on amount of applied current; and a driving transistor having a first terminal connected to a second terminal of the organic electroluminescence element and a second terminal connected to a second polarity terminal and controlling current flow from the first polarity terminal to the second polarity terminal or vice versa in response to the output data signal from the third terminal of the switching transistor to control light-emission of the organic electroluminescence element, wherein light emission of a current display group among the display groups and scanning of a next display group are simultaneously performed and the plurality of display cells of the current group simultaneously start lighting and simultaneously stop lighting, during a display period.

2. The organic electroluminescence panel of claim 1, wherein the display cell further comprises a storage capacitor having one terminal connected to the third terminal of the switching transistor and the other terminal connected to the second polarity terminal and maintaining the data signal from the third terminal of the switching transistor for a predetermined time.

3. The organic electroluminescence panel of claim 1, wherein the first terminal of the organic electroluminescence element comprises a cathode terminal and the second terminal of the organic electroluminescence element comprises an anode terminal, the first polarity terminal being supplied with a voltage so as to apply a positive potential between the anode terminal and cathode terminal of the organic electroluminescence element.

4. The organic electroluminescence panel of claim 1, wherein:

the first terminal of the driving transistor is connected to the second terminal of the organic electroluminescence element for light emission, and the first terminal of the organic electroluminescence element is connected to the first terminals of the organic electroluminescence elements adjacent thereto left and right through a voltage supplying electrode and is supplied with an organic electroluminescence driving voltage through the voltage supplying electrode.

5. The organic electroluminescence panel of claim 1, wherein:

the first terminal of the driving transistor is connected to the second terminal of the organic electroluminescence element for light emission, the first terminal of the organic electroluminescence element is grounded, and the second terminal of the driving transistor is connected to a voltage supplying electrode, and is supplied with the organic electroluminescence driving voltage through the voltage supplying electrode.

6. An organic electroluminescence display comprising an organic electroluminescence panel including a plurality of data lines transmitting data signals, a plurality of scanning lines transmitting scanning signals, and a plurality of organic electroluminescence display cells arranged in a matrix defined by the data lines and the scanning lines, wherein the display cells are grouped into a plurality of display groups, each display group including a plurality of display cells associated with a predetermined plurality of the adjacent scanning lines, each display cell including a switching transistor having a first terminal connected to one of the data lines, a second terminal connected to one of the scanning lines, and a third terminal, the switching transistor outputting the data signal through the third terminal in response to the scanning signal;

an organic electroluminescence element having a first terminal connected to a first polarity terminal and emitting light based on amount of applied current; and a driving transistor having a first terminal connected to a second terminal of the organic electroluminescence element and a second terminal connected to a second polarity terminal and controlling current flow from the first polarity terminal to the second polarity terminal or vice versa in response to the output data signal from the third terminal of the switching transistor to control light-emission of the organic electroluminescence element, wherein the organic electroluminescence display further comprises an organic electroluminescence driving voltage source sequentially outputting organic electroluminescence driving voltages to the display groups including predetermined numbers of rows disposed in the organic electroluminescence panel such that a current display group of the display groups is applied with an organic electroluminescence driving voltage for scan, and after completion of the scan, the current display group is applied with an organic electroluminescence driving voltage for light-emission and simultaneously a next display group is applied with an organic electroluminescence driving voltage for scan, and the plurality of display cells of the current group simultaneously start lighting and simultaneously stop lighting, during a display period.

7. The organic electroluminescence display of claim 6, wherein the display cell further comprises a storage capacitor having one terminal connected to the third terminal of the switching transistor and the other terminal connected to the second polarity terminal and maintaining a data signal from the third terminal of the switching transistor for a predetermined time.

8. The organic electroluminescence display of claim 6, wherein:

the first terminal of the driving transistor is connected to the second terminal of the organic electroluminescence element for light emission, and the first terminal of the organic electroluminescence element is connected to the first terminals of the organic electroluminescence elements adjacent thereto left and right through a voltage supplying electrode and is supplied with an organic electroluminescence driving voltage through the voltage supplying electrode.

9. The organic electroluminescence display of claim 8, wherein the first terminal of the organic electroluminescence element comprises a cathode terminal and the second terminal of the organic electroluminescence element comprises an anode terminal, the first polarity terminal being supplied with a voltage so as to apply a positive potential between the anode terminal and cathode terminal of the organic electroluminescence element.

10. The organic electroluminescence display of claim 8, wherein the voltage supplying electrode is provided for each display group.

11. The organic electroluminescence display of claim 6, wherein:

the first terminal of the driving transistor is connected to the second terminal of the organic electroluminescence element for light emission, and the first terminal of the organic electroluminescence element is grounded, the second terminal of the driving transistor is connected to a voltage supplying electrode, and is supplied with the organic electroluminescence driving voltage through the voltage supplying electrode.

12. The organic electroluminescence display of claim 11, wherein the first terminal of the organic electroluminescence element comprises a cathode terminal and the second terminal of the organic electroluminescence element comprises an anode terminal, the first polarity terminal being supplied with a voltage so as to apply a positive potential between the anode terminal and cathode terminal of the organic electroluminescence element.

13. The organic electroluminescence display of claim 11, wherein the voltage supplying electrode is provided for each display group.

14. The organic electroluminescence display of claim 6, wherein the number of the organic electroluminescence driving voltages outputted by the driving voltage source is equal to the number of the display groups.

15. The organic electroluminescence display of claim 14, wherein the driving voltage source outputs the organic electroluminescence driving voltage for a display period of a corresponding display group.

16. The organic electroluminescence display of claim 6, wherein one of the display groups performs scanning operation while the remaining display groups maintain display operation that the display cells emit light.

17. The organic electroluminescence display of claim 16, wherein one of the display groups performs a light-emitting display operation after completion of scanning operation and simultaneously, a next display group performs scanning operation.

18. The organic electroluminescence display of claim 17, wherein the scanning is sequentially performed from a first scanning line of each display group, and the light-emitting display operations in each display group are simultaneously performed.

19. A driving apparatus of an organic electroluminescence display including an organic electroluminescence panel including a plurality of data lines transmitting data signals, a plurality of scanning lines transmitting scanning signals, a plurality of organic electroluminescence display cells arranged in a matrix defined by the data lines and the scanning lines wherein the display cells are grouped into a plurality of display groups each display group including a plurality of display cells associated with a predetermined plurality of adjacent scanning lines, the driving apparatus comprising:

an organic electroluminescence driving voltage source sequentially outputting organic electroluminescence driving voltages to the display groups such that a current display group of the display groups is applied with an organic electroluminescence driving voltage for scan, and after completion of the scan, the current display group is applied with an organic electroluminescence driving voltage for light-emission and simultaneously a next display group is applied with an organic electroluminescence driving voltage for scan, and the plurality of display cells of the current group simultaneously start lighting and simultaneously stop lighting, during a display period.

20. The driving apparatus claim 19, wherein the number of the driving voltages outputted by the driving voltage source is equal to the number of the display groups.

21. The driving apparatus claim 20, wherein the driving voltage source outputs the driving voltage for a display period of a corresponding display group.

22. A driving method of an organic electroluminescence display including an organic electroluminescence panel including a plurality of data lines transmitting data signals, a plurality of scanning lines transmitting scanning signals, a plurality of organic electroluminescence display cells arranged in a matrix defined by the data lines and the scanning lines, wherein the display cells are grouped into a plurality of display groups, each display group including a plurality of display cells associated with a predetermined plurality of adjacent scanning lines, the method comprising:

(a) performing scanning operation for a current display group of display groups and, after completion of the scan, controlling a light-emitting display operation for the current display group and simultaneously performing scanning operation for a next display group, and controlling the plurality of display cells of the current group to start lighting simultaneously and to stop lighting simultaneously, during a display period.

23. The method of claim 22, wherein (a) comprises:

(a-1) scanning data to an n-th display group of an organic electroluminescence panel including K display groups through K common terminals, where n is an integer larger than 1 and smaller than K;

(a-2) performing a light-emitting display operation for the n-th display group after completion of the scanning for the n-th display group in (a-1);

(a-3) determining whether the n is equal to the K according to the light-emitting display operation for the n-th display group in (a-2);

(a-4), increasing the n value by '1' and returning to (a-1) if the n is not equal to the K in (a-3); and (a-5) ending display of image signals for one frame if the n is equal to the K in the step (a-3).

* * * * *